United States Patent [19]

Dinsdale

[11] Patent Number: 4,843,945

[45] **Date of Patent: * Jul. 4, 1989**

[54] APPARATUS FOR MAKING AND BREAKING THREADED WELL PIPE CONNECTIONS

[75] Inventor: Michael C. Dinsdale, Dallas, Tex.

[73] Assignee: National-Oilwell, Houston, Tex.

[ * ] Notice: The portion of the term of this patent subsequent to Mar. 22, 2005 has been disclaimed.

[21] Appl. No.: 23,385

[22] Filed: Mar. 9, 1987

[51] Int. Cl.[4] ..... B25B 13/50

[52] U.S. Cl. ..... 81/57.34; 166/77.5; 175/85

[58] Field of Search ..... 166/77.5, 78, 85; 175/52, 85; 81/57.16, 57.18, 57.24, 57.35, 57.4

[56] References Cited

U.S. PATENT DOCUMENTS

| | | | |
|---|---|---|---|
| 2,181,641 | 11/1939 | Hicks | 81/57.18 |
| 2,450,934 | 10/1948 | Calhoun | 166/77.5 |
| 2,453,369 | 11/1948 | Grable et al. | 81/57.34 |
| 2,544,639 | 3/1951 | Calhoun | 81/57.16 |
| 2,703,221 | 3/1955 | Gardner | 81/57.18 |
| 2,705,614 | 4/1955 | McKibben et al. | 81/57.16 |
| 2,850,929 | 9/1958 | Crookston et al. | 81/57.24 X |
| 2,969,702 | 1/1961 | Cornish et al. | 81/57.24 X |
| 3,308,691 | 3/1967 | Guier | 81/54 |
| 3,500,708 | 3/1970 | Wilson | 81/57.34 |
| 3,629,927 | 12/1971 | Palmer | 29/240 |
| 3,902,385 | 9/1975 | Haby | 81/57.34 |
| 3,957,113 | 5/1976 | Jones et al. | 166/77.5 |
| 3,961,399 | 6/1976 | Boyadjieff | 24/263 DG |
| 4,348,920 | 9/1982 | Boyadjieff | 81/57.25 |
| 4,421,179 | 12/1983 | Boyadjieff | 175/85 X |
| 4,732,061 | 3/1988 | Dinsdale | 81/57.34 |

*Primary Examiner*—James G. Smith

*Attorney, Agent, or Firm*—Roylance, Abrams, Berdo & Goodman

[57] ABSTRACT

An apparatus for making and breaking threaded well pipe connections has a stationary support mountable on a rig floor and positioning arms mounted on the stationary support. The positioning arms selectively support and position a movable frame which carries power tongs for clamping pipes. By operation of the positioning arms, the power tongs can be operatively disposed to act on a pipe at the well center, positioned in a stowed position or disposed in a mousehole position to act on a pipe in the mousehole.

16 Claims, 14 Drawing Sheets

APPARATUS FOR MAKING AND BREAKING THREADED WELL PIPE CONNECTIONS

FIELD OF THE INVENTION

This invention relates to apparatus to be installed on a well drilling rig for making and breaking threaded connections of well pipe, such as the connections in a drill string made up of drill pipe and drill collars.

RELATED APPLICATION

Apparatus disclosed in this application is also disclosed and claimed in my copending application Ser. No. 23,384, filed Mar. 9, 1987, now U.S. Pat. No. 4,732,061 issured Mar. 22, 1988.

BACKGROUND OF THE INVENTION

In the drilling of oil, gas and geothermal wells, strings of drill pipe and other well pipe must be made up as the string is run into the well, and disassembled into individual lengths of pipe (referred to as joints) as the string is withdrawn from the well. The successive joints of well pipe are connected together by screw thread connectors. When the well depth is shallow, making and breaking the threaded connections can be done with relative ease, as by using pipe tongs manipulated by hand. In the case of deep wells, many more joints of pipe are required and it becomes necessary to speed up the making and breaking of the connections between joints and to minimize manual labor. In all cases, it is desirable, and in the case of a deep well essential, to minimize the time required to accomplish a "trip" of the pipe out of and into the well. Thus, for example, to replace a worn drill bit the entire drill string must be pulled from the drill hole, with each of the many threaded connections being broken as the pipe is pulled, the drill bit then being replaced, and the entire string then being reassembled again as the new bit and string are run into the hole. Prior art workers have accordingly developed power operated tongs of various kinds and power operated spinners, the power tongs being capable of initially breaking the threaded connections and of final tightening them, and the power operated spinners serving to rotate the pipe rapidly during final unthreading or initial makeup of the connection. The tongs and spinners have been installed on the drilling rig in various fashions.

Apparatus according to the invention is applicable to all drilling procedures which require a well pipe structure in which joints of pipe are connected by screw thread connectors, including but not limited to rotary table drilling and rotary drilling with the use of power swivels. During rotary table drilling a length of rod of square transverse cross section, called a Kelly, is connected to the drill string and is engaged by the drive bushing of a rotary table at the rig floor, the Kelly descending through the drive bushing as drilling procedes. Alternatively, the Kelly is replaced by a shorter device, such as a Kelly sub. In either case, each time drilling has proceeded far enough to require that a new joint of pipe be added to the string, it is necessary to support the string, as with slips, detach the Kelly or sub, attach the Kelly or sub to the upper end of the new joint of pipe, then attach the other end of the new joint to the string. To facilitate such a series of operations, it has become standard practice to provide in the rig floor, in a location adjacent to the string but spaced laterally therefrom, a receptacle to accommodate the new joint of pipe, this receptacle being called a mousehole. It is therefor desirable that the power tongs, as well as the spinner, be of such nature as to be positionable selectively in alignment with the axis of the drill string, i.e., at well center, and in alignment with the mousehole, as well as in a stowed location spaced from both the well center and the mousehole. Such mobile apparatus have been proposed, as seen for example in U.S. Pat. No. 4,348,920 to Boyadjieff. However, though such apparatus have the advantage of satisfying the need for the multi-position capability, the manner in which mobility has been achieved tends toward instability and undue complication and there has been a continuing need for improvement.

SUMMARY OF THE INVENTION

Broadly considered, apparatus according to the invention comprises a stationary support adapted to be mounted on the rig to extend upwardly from the rig floor in a position spaced from the well center; power operated tongs; a frame which carries the power tongs and constitutes a movable support means; and supporting and positioning means operative to selectively position the tongs in a stowed position, a well center position in which the tongs are disposed to act on a pipe at the well center, and a mousehole position in which the tongs are disposed to act on pipe in the mousehole receptacle. The supporting and positioning means comprises means for mounting the supporting and positioning means on the stationary support, first power operated means for moving the movable support means upwardly and downwardly to adjust the space between the tongs and the rig floor, and second power operated means for moving the movable support means selectively between the stowed position, the well center position and the mousehole position. Advantageously, the movable support means also carries a power spinner.

The supporting and positioning means advantageously comprises at least one telescopically extendable and retractable arm, the frame constituting the movable support means is mounted on one end of the at least one arm, and the other end of the at least one arm is mounted on the stationary support. Advantageously, the frame is suspended from the arm and can be pivoted relative to the arm about a horizontal axis, and power operated means are provided for swinging the frame, and therefore the tongs, from an upright position, in which the tongs are disposed to act on a vertical pipe, to an included position, in which the tongs are disposed to act on a pipe in the mousehole. Other power means is provided to extend and retract the at least one arm for horizontal movement of the frame and tongs. The at least one arm can be mounted on the stationary support for swinging movement about a horizontal axis, and such swinging movement can be used to transfer the frame and tongs to the stowed position, and when that embodiment of the invention is employed, the stationary support can be closer to the well center. Alternatively, the at least one arm can remain in horizontal position and movement of the frame and tongs to the stowed position can be accomplished simply by retraction of the at least one arm. The stationary support can comprise one or more upright support members and the upright support members can be telescopically extendable and retractable to allow the space between the tongs and the rig floor to be adjusted. When the arm or arms of the supporting and positioning means are not swingable, they can be mounted on a slide member, and movement of the frame and the tongs can be accomplished by cable means.

Both the tongs and the spinner are power operated devices so constructed and arranged as to effectively engage the pipe by relative lateral movement and the support frame is open at one side o allow the support frame to embrace the well pipe as the pipe is engaged by the tongs and spinner. Advantageously, the power tongs is in the form of a unit comprising an upper clamp assembly which rests upon a lower clamp assembly, each such assembly having a well pipe accommodating opening of a size and shape to freely accommodate a well pipe or a threaded connector member, such openings being aligned one above the other. Each clamp assembly is provided with power operated jaws to clamp the pipe or connector member. Linear actuators or other power devices are provided to effect relative rotation of the two clamp assemblies about the pipe axis in two directions, relative rotation in one direction serving to make up the threaded connection, relative rotation in the opposite direction serving to break the threaded connection.

All operations of the apparatus are accomplished by power operated devices, advantageously pressure fluid operated devices, and a control system is provided for remote operation.

IDENTIFICATION OF THE DRAWINGS

DETAILED DESCRIPTION OF THE INVENTION

Embodiment Shown in FIGS. 1–8

Figure 1:
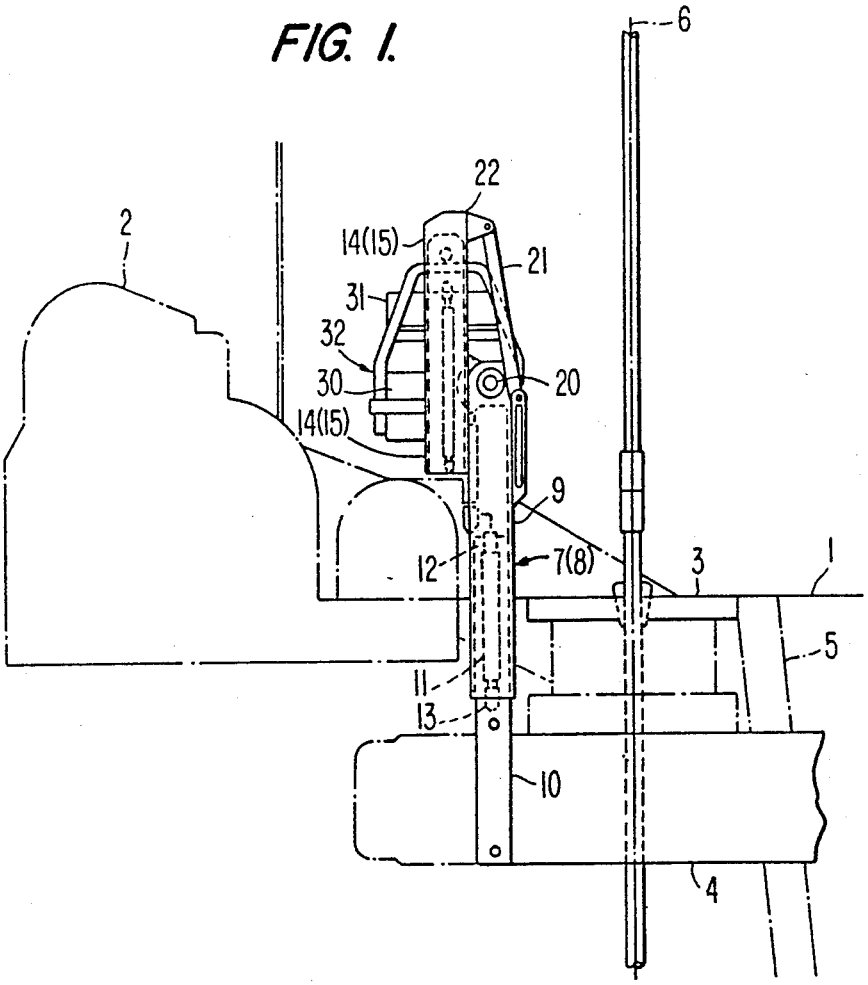
FIG. 1 is a semi-diagrammatic side elevational view of apparatus according to one embodiment of the invention, showing the movable support frame in the stowed position.
Figure 2:
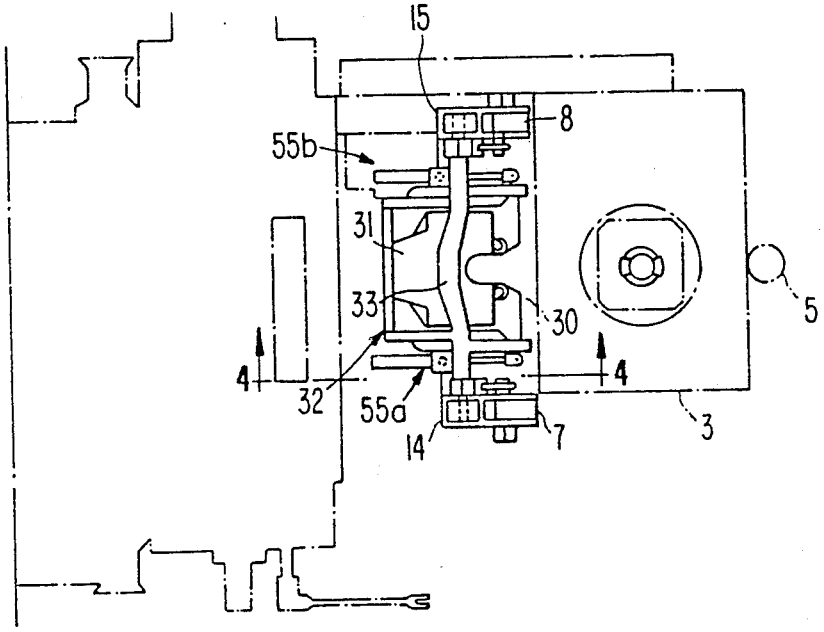
FIG. 2 is a top plan view of the apparatus with the parts disposed as in FIG. 1.
Figure 3:
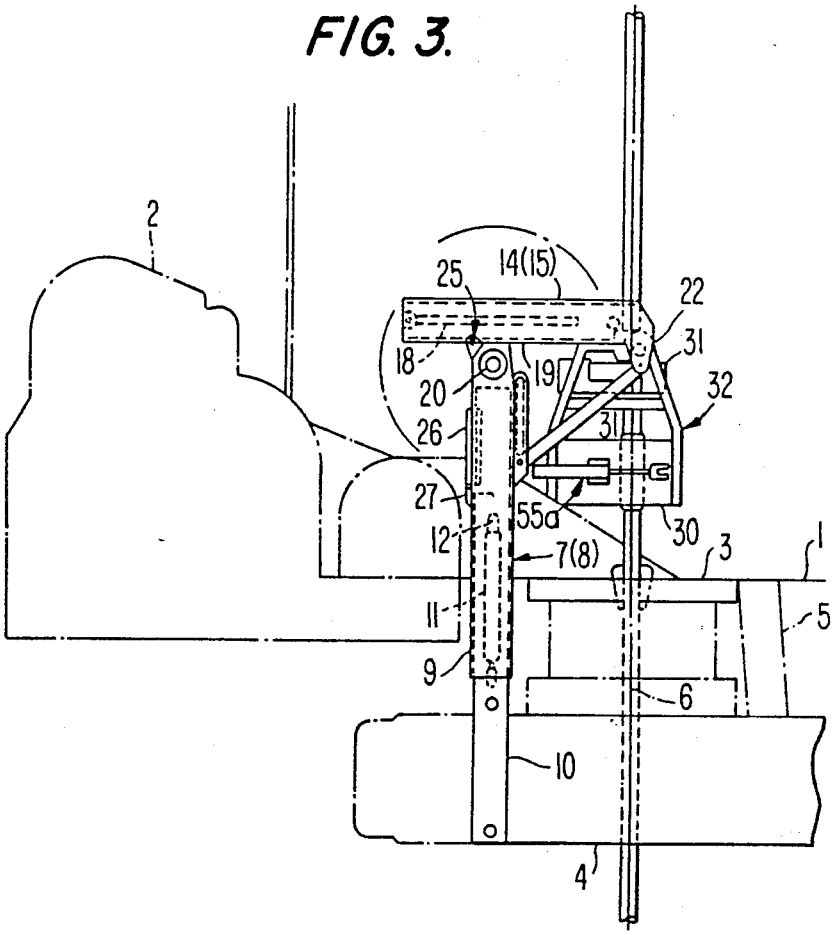
FIG. 3 is a view similar to FIG. 1 but showing the movable support frame in the well cente position.
Figure 4:
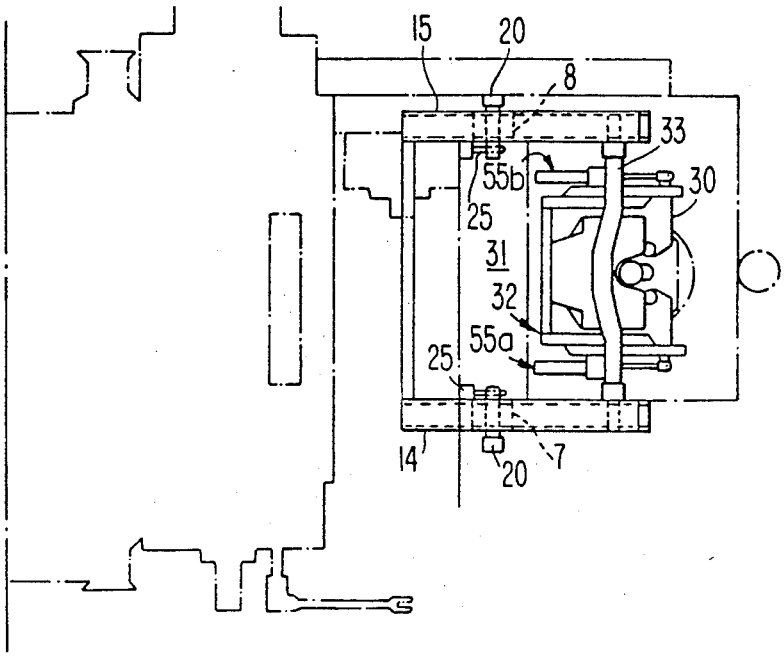
FIG. 4 is a top plan elevational view of the apparatus with the parts in the positions seen in FIG. 3.

The apparatus is mounted on a conventional drilling rig including a rig floor 1, drawworks 2, rotary table 3, rotary table beams 4 and mousehole receptacle 5. In usual fashion, the rotary table 3 defines the well bore axis 6 and, therefore, the well center position. The drawworks is spaced laterally from the well center position by a considerable distance, and the mousehole receptacle is spaced from the well center on the side opposite the drawworks and is located between the rotary table beams.

In this embodiment, the stationary support of the apparatus comprises two vertical legs 7 and 8, the two legs being identical and telescopically extendable and retractable. Thus, each leg 7, 8 is hollow, of rectangular transverse cross section and comprises a hollow upper member 9 within which is telescopically disposed the upper end portion of a lower member 10. A conventional double acting hydraulically operated linear actuator extends longitudinally within the hollow leg and has the upper end of its cylinder 11 pivotally connected at 12 to upper leg member 9, as by a conventional cross pin and clevis, the free end of the piston rod 13 being similarly connected to the lower leg member 10. The actuators can thus be operated to extend both legs 7, 8 simultaneously from the shortened condition of FIG. 1 to the extended condition of FIG. 5 and back to the shortened condition.

Mounted on upper members 9 of the legs are two mutually identical pivoted support and positioning arms 14 and 15 which are telescopically extendable and retractable. Each arm 14, 15 comprises a hollow first member 16, FIG. 5, of larger rectangular transverse cross section and a second member 17 of smaller rectangular transverse cross section, member 17 extending telescopically within member 16. A conventional double acting hydraulically operated linear actuator 18 extends longitudinally within each arm 14, 15 and has the blind end of its cylinder pivotally connected to member 16 and the free end of its piston rod connected to member 17, the arrangement being such that simultaneous operation of actuators 18 can extend the arms telescopically from the shortened condition seen in FIGS. 1 and 3 to the extended condition seen in FIG. 5 and back to the shortened condition.

Each arm 14,15 is equipped with a flange 19 projecting laterally from member 16 of the arm in the plane of that side of member 16 nearer the other arm, each flange 19 being rigidly secured to a horizontal shaft 20 journalled in the upper end of member 9 of the corresponding leg 7,8. A brace 21 is provided for each arm 14 and 15, the brace being pivoted at one end to a flange 22 on the end of member 16 most distant from shaft 20. The other end of each brace 21 has a lateral projection 23 engaged in a vertical slot 24 in a flange secured to to and extending along the upper portion of member 9 of the corresponding leg. Arms 14,15 are thus pivotable about the common axis of shafts 20 between the vertical position seen in FIG. 1 and the horizontal position seen in FIGS. 3–6.

Two crank arms 25 are provided, each secured rigidly to one end of a different one of shafts 20 and projecting radially therefrom. Two conventional double acting hydraulically operated linear actuators 26 each have the free end of their piston rods pivotally connected to the free end of a different one of the crank arms 25, the blind end of the cylinders **26*a* of actuators 26 being pivoted to a different one of two flanges 27 each secured to a different one of leg members 9 a substantial distance below shafts 20. The arrangement is such that, when the piston rods of actuators 26 are simultaneously driven downwardly, arms 14,15 are pivoted counterclockwise as viewed in FIG. 1 until the arms are vertical and each extends adjacent to the side of the respective leg member 9 most distant from the well center. When the piston rods of actuators 26 are driven in the opposite direction, arms 14,15 are pivoted clockwise, as viewed in FIG. 1, to the horizontal position seen in FIGS. 3–6. Projections 23 remain engaged in slots 24** at all times, traveling to the upper ends of the slots when the support and positioning arms are swung to their vertical position and to the lower ends of the slots as the arms are swung to their horizontal positions.

Figure 7:
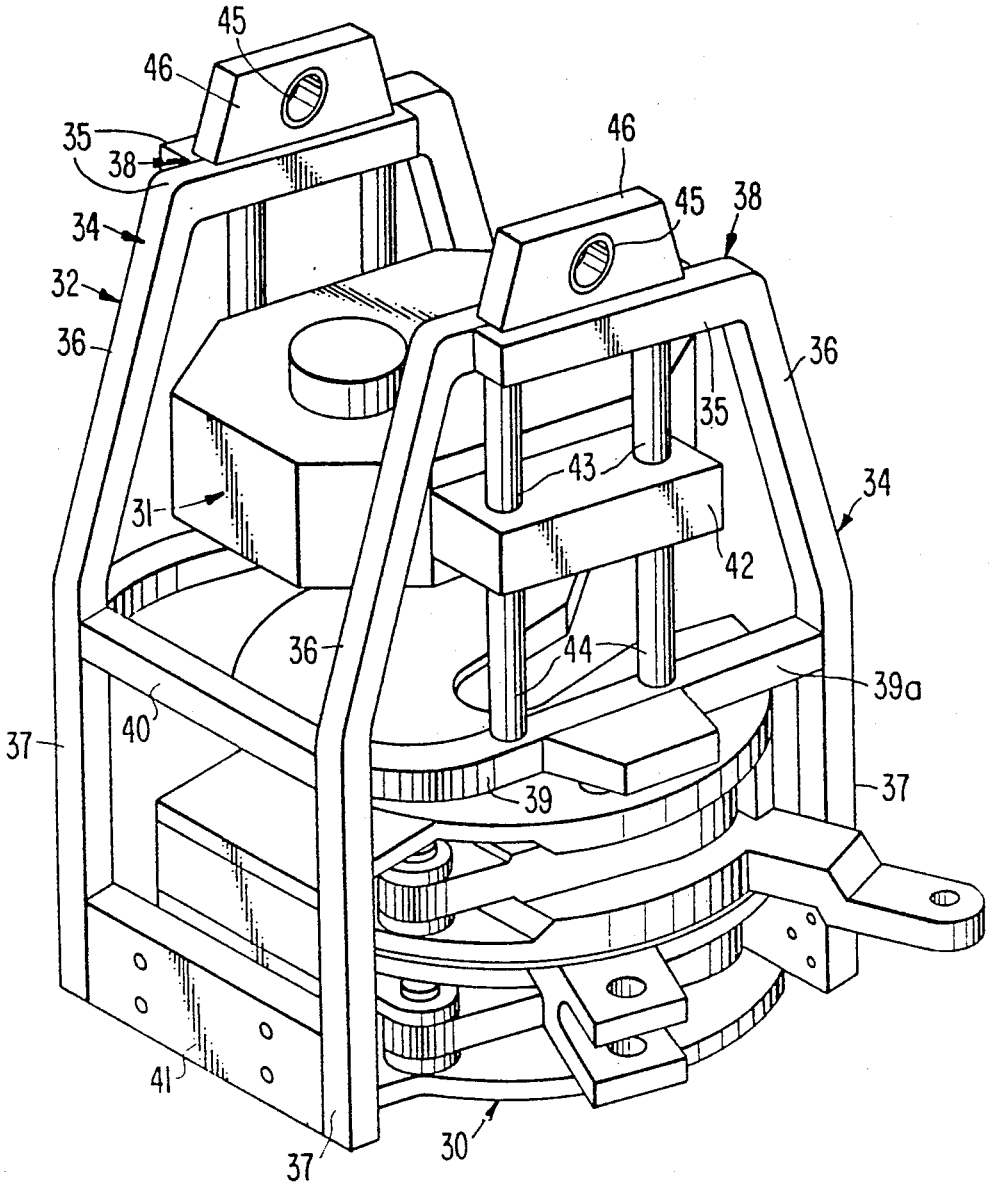
FIG. 7 is an isometric view of the movable support frame with tongs and spinner in place but with some parts removed for clarity of illustration.
Figure 8:
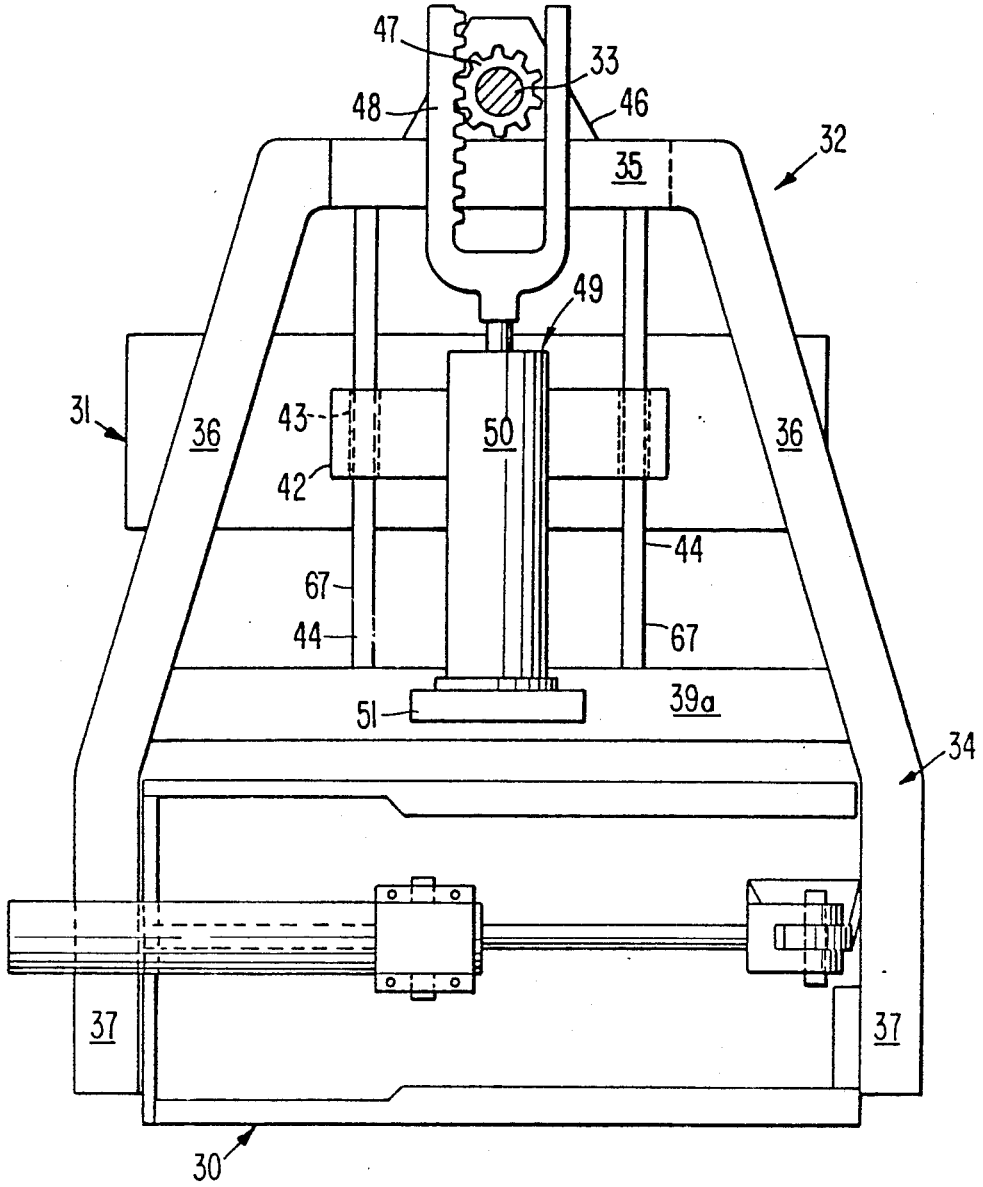
FIG. 8 is a side elevational view of the structure shown in FIG. 7, with power actuators in place.

The power tongs, indicated generally at 30, and a conventional power spinner 31 are carried by a movable support frame indicated generally at 32. Frame 32 is suspended from a horizontal shaft 33, FIGS. 2 and 4, which, in this embodiment, is secured rigidly to and extends between the outer ends of members 17 of supporting and positioning arms 14,15. Frame 32 comprises four identical members 34, FIGS. 7 and 8, each formed from an integral metal bar and having the general shape of an inverted L, the feet 35 of the L being straight and relatively short and the stems of the L being bent to provide straight portions 36 and 37. Each side member 38 of the frame is made up of two members 34 with the feet 35 thereof welded together side-by-side so that portions 35 are horizontal at the top of the frame, portions 36 diverge downwardly and outwardly, and portions 37 depend vertically, when the frame is upright as seen in FIG. 7. At the junctures between portions 36 and 37 of members 34, each side member 38 has a cross brace 39 having a straight portion **39*a* disposed in the same place as the foot 35 which is outermost in the completed frame. Viewed as in FIG. 7, frame 32 can be considered as having a front and a back. At the back of the frame, side members 38 are connected by a cross brace 40 joined to the corresponding junctures between portions 36 and 37 of the respective members 34. A second cross brace 41 interconnects the lower ends of the respective portions 37. As hereinafter described, power tongs unit 30 is secured to cross brace 41 and to the lower ends of the portions 37 which are at the front of frame 32. Power spinner 31 has two oppositely projecting side flanges 42 provided with laterally spaced vertical bores 43. At each side of the spinner, two vertical guide rods 44 each extend through a different one of the bores 43 and are rigidly secured to portion 39*a* of cross brace 39 and the portion 35 aligned thereabove so that, while the spinner is restrained against lateral movement relative to the frame, the spinner is free for limited vertical movement relative to the frame. Shaft 33 extends through coaxially aligned bushings 45 carried by two brackets 46 each welded to and projecting upwardly from the top of a different one of side members 38, so that the combination of frame 32, power tongs 30 and spinner 31, while securely supported by shaft 33**, is free to swing about the horizontal axis defined by the shaft and bushings.

Advantageously, relative pivotal movement between frame 32 and shaft 33 is accomplished by remote operation in timed relation to operation of the actuators which swing support arms 14 and 15, extend and retract the support arms and extend and retract legs 7 and 8. To accomplish this, frame 32 must be swung by power means. Accordingly, shaft 33 has one end portion which projects beyond the corresponding bracket 46 and a pinion 47 is fixed rigidly to the projecting end portion of the shaft. The pinion is meshed with a rack 48 secured to the end of the piston rod of a conventional double acting hydraulically powered rectilinear motor 49. The blind end of the cylinder 50 of motor 49 is secured to a mounting bracket 51 which is fixed to and projects laterally from portion **39*a* of cross brace 39. As support arms 14 and 15 are swung clockwise (as viewed in FIGS. 3 and 5) from the vertical position of FIG. 1 to the horizontal position of FIG. 3, motor 49 is operated to retract its piston rod to turn pinion 47 in a direction tending to swing frame 32 in a counterclockwise directions, the rate of operation of motor 49 being such that frame 32 remains vertical as the support arms are swung from vertical to horizontal. When the support arms are swung back to the vertical position, motor 49 is operated to extend its piston rod and thereby turn pinion 47 in a direction which tends to swing frame 32 clockwise relative to the support arms at a rate maintaining frame 32** vertical.

Figure 11:
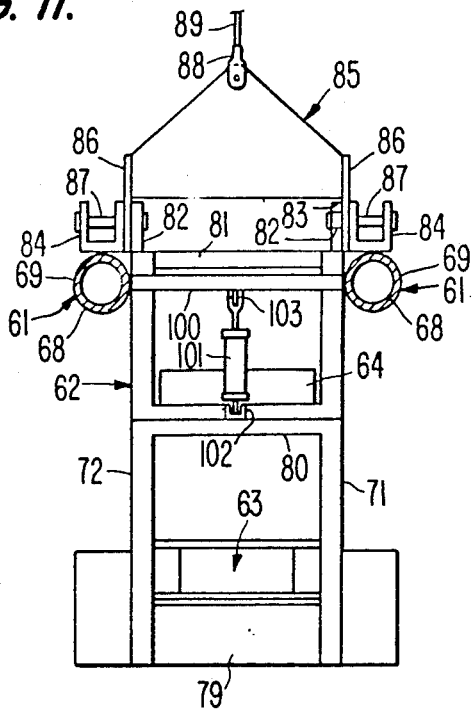
FIG. 11 is a fragmentary view, partly in vertical cross section, taken generally on line 11—11, FIG. 9.
Figure 9:
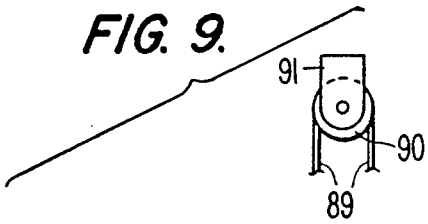
FIG. 9 is a side elevational view of apparatus according to another embodiment of the invention, with the movable support frame in well center position.
Figure 10:
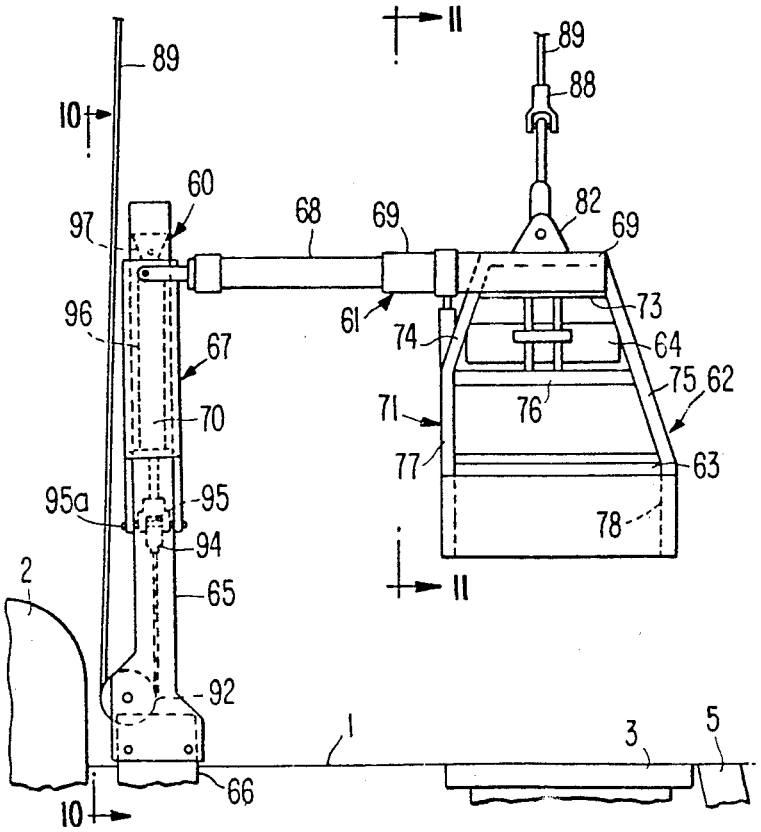
FIG. 10 is an elevational view taken generally on line 10—10, FIG. 9.
Figure 10:
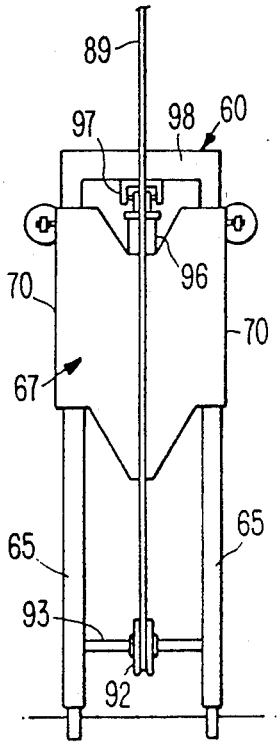

The Embodiment Shown in FIGS. 9–11

The apparatus of this embodiment of the invention is again adapted for mounting on a conventional drilling rig floor 1 having a drawworks 2, a rotary table 3 and a mousehole receptacle 5. The apparatus comprises an upright support frame 60, two parallel telescopically extendable and retractable arms 61 and a movable support frame 62 on which are mounted the power tongs 63 and power spinner 64.

Stationary support frame 60 comprises two mutually parallel legs 65 which are spaced apart and each secured to the substructure at the rig floor by a mounting bracket 66 and a vertical slide beam 67. The vertical slide beam 67 of open rectangular horizontal cross section slidably embraces legs 65 so as to be movable upwardly and downwardly along support frame 60. Arms 61 each comprise a hollow cylindrical portion 68 of smaller diameter and a hollow cylindrical portion 69 of larger diameter, the two portions being telescopically engaged and the free ends of portions 68 being pivotally connected to the respective sides 70 of slide beam 67, as shown.

Movable support frame 62 comprises two flat sides 71 and 72 which are mutually parallel. Each side 71, 72 includes a top member 73, a shorter straight portion 74 and a longer straight portion 75, portion 74 slanting downwardly and rearwardly from the corresponding end of member 73 and portion 75 slanting downwardly and forwardly from the opposite end of member 73. A cross brace 76, parallel to member 73, has its ends connected respectively to the lower end of portion 74 and an intermediate point along the length of portion 75. A longer straight portion 77 depends from the lower end of portion 74 and a shorter straight portion 78 depends from the lower end of portion 75. At the bottom of the frame, portions 77 are interconnected by a cross brace 79, and a second cross brace 80 connects the junctures between portions 75 and 77 of the two sides. At the top of the frame, sides 71 and 72 are connected by a flat plate 81. Power tongs 63 are mounted on the lower portion of frame 62, as by being secured to cross brace 79 and structure at the lower ends of portions 78. Power spinner 64 is mounted on the upper portion of frame 62, as in the manner hereinbefore described for spinner 31 of FIGS. 1–8. The front of frame 62 is open to allow the tongs and spinner to engage a threaded pipe connection or a joint of pipe.

Rigidly secured to the upper edges of the respective top members 73 of the sides of frame 62 are two upwardly projecting support flanges 82 each apertured to accommodate a bushing 83, the bushings being coaxially aligned to establish a pivotal axis extending at right angles to the sides of the frame. Rigidly secured to each of the larger diameter portions 69 of the support arms 61 is an upwardly projecting clevis flange 84. A spreader beam 85 is provided and includes apertured flanges 86 which are spaced apart by a distance allowing the flanges to lie adjacent the outer faces of the respective support flanges 82. Stub shafts 87 are provided for each support flange 82, each shaft 87 extending through the corresponding bushing 83, the aperture of the corresponding flange 86 of the spreader beam, and the apertures of the corresponding clevis flange 84.

In a location spaced above flanges 86 and centered therebetween, spreader beam 85 has an aperture accommodating the pin of a cable clevis 88 fixed to one end of a cable 89. From clevis 88, the cable extends upwardly and over a sheave 90, FIG. 9, rotatably supported by flanges 91 secured to an upper portion of the drilling rig tower (not shown). From sheave 90, cable 89 extends downwardly and is run beneath a second sheave 92 carried by a shaft 93 extending between lower portions of legs 65 of frame 60. From the second sheave, the cable is routed upwardly and secured by cable eye 94 and rod clevis 95 to the free end of the piston rod of a hydraulically powered rectilinear power device 96 which is located within slide beam 67 and has the blind end of its cylinder pivotally connected by clevis 97 to cross beam 98 at the top of frame 60. Pin 95*a*, which connects cable eye 94 to clevis 95, also connects clevis 95 to slide beam 67.

Larger portions 69 of support arms 61 are rigidly interconnected by a cross brace 100. A hydraulically powered rectilinear power device 101 has the blind end of its cylinder secured to cross brace 80 by clevis flange 102, the free end of the piston rod of the power device being connected to cross brace 100 by clevis flange 103. Operation of power device 101 to extend its piston rod swings frame 62 about the axis defined by bushings 83 in a counterclockwise direction relative to support arms 61. Operation of the power device in the opposite direction swings frame 62 clockwise relative to the support arms.

Power device 96 serves as means for determining the vertical position of support frame 62. Thus, operation of device 96 to extend its piston rod moves the combination of slide beam 67, support arms 61 and frame 62 downwardly while support arms 61 retain their generally horizontal position because of the action of cable 89 and sheaves 90 and 92. Operation of power device 96 in the opposite direction moves the combination of the slide beam, support arms and support frame upwardly. It will be apparent that the extent of upward and downward movement of the support frame is determined by the extent of retraction or extension of the piston rod of power device 96. At least one of the support arms 61 is provided with a conventional double acting hydraulically operated linear actuator (not shown) housed within the support arm in the general manner hereinbefore described with reference to the embodiment of FIGS. 1–8 and operative to extend and retract arms 61. Accordingly, arms 61 can be retracted to move frame 62 to a stowed position between the well center and frame 60, extended to move frame 62 to bring the power tongs and power spinner into alignment with the well center, an further extended to bring frame 62 to the mousehole position. During such further extension, or after completion thereof, power device 101 is operated to extend its piston rod and swing frame 62 counterclockwise to the proper angle for alignment of the power tongs and spinner with mousehole receptacle 5. Power device 101 is operated to retract its piston rod and return frame 62 to the vertical position when the frame is returned to its well center position.

Power Tongs Shown in FIGS. 12–19

Though other power tongs can be employed in accordance with the invention, FIGS. 12–19 illustrate one particularly advantageous form of power tongs comprising an upper tongs unit, indicated generally at 105, and a lower tongs unit, indicated generally at 106. For convenience and clarity, both units will be described as having a front, via which the well pipe or pipe connector will enter, and a back and it will be assumed that the units are viewed from the back looking forward, so as to have a left side and a right side. Unit 105 comprises a flat upper plate 107 and a flat lower plate 108 which are spaced apart vertically and rigidly interconnected by a rectangular plate 109 at the back, a flat intermediate partition 110, and two coplanar front plates 111. Unit 106 similarly comprises a flat upper plate 112 and a flat lower plate 113 spaced apart vertically and secured rigidly together by flat back plate 114, flat intermediate partition 115 and two front plates 116.

Figure 12:
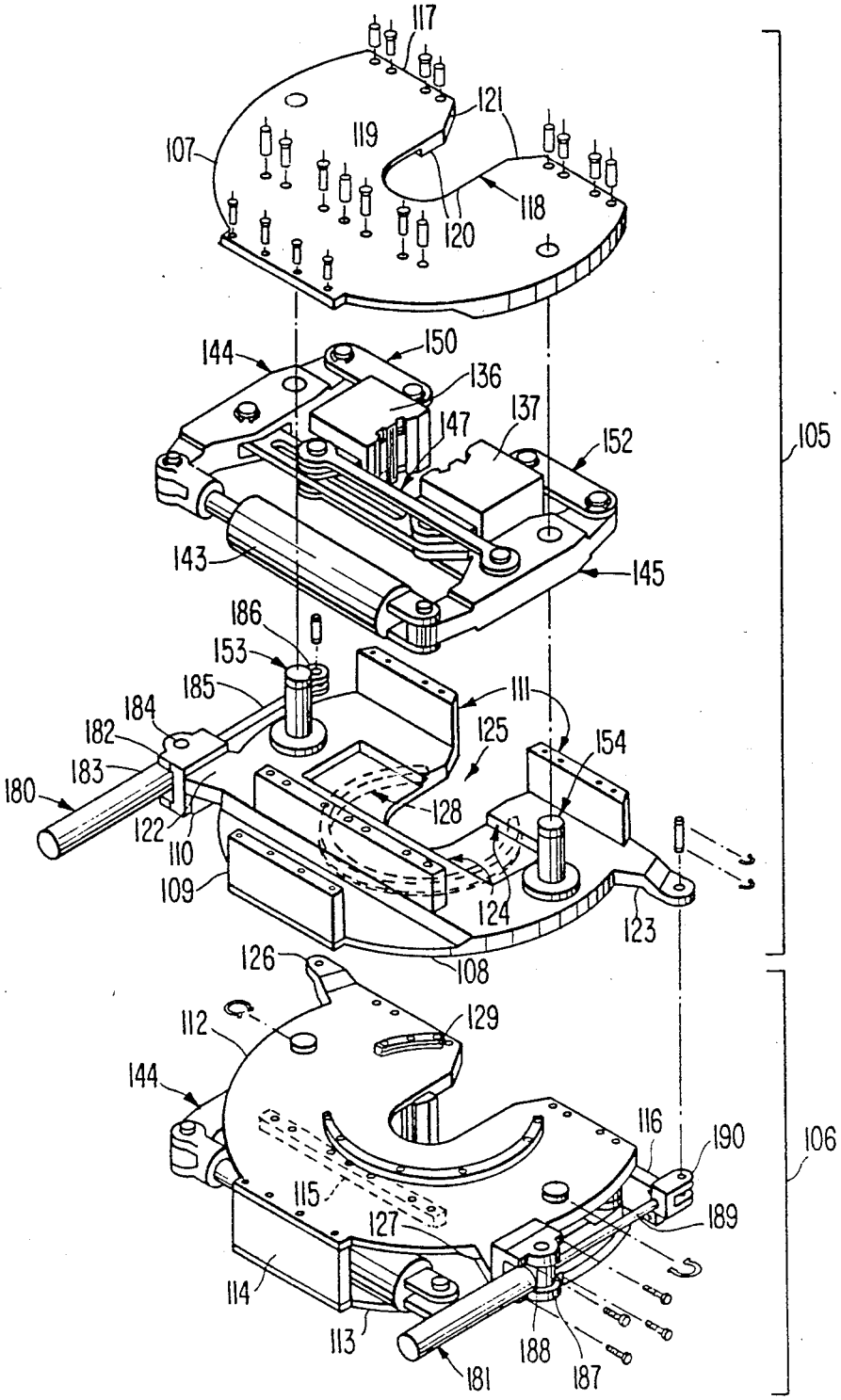
FIG. 12 is an isometric view of power tongs useful in the apparatus of FIGS. 1 and 9, the upper tong assembly shown exploded, the lower tong assembly shown assembled.

The periphery of upper plate 107 extends as part of a circle interrupted by straight front edge portions 117 which extend chordally with respect to the circular peripheral portion, are mutually aligned and are spaced each on a different side of an elongated generally U-shaped opening 118 sized to accommodate a threaded connector or tool joint. Opening 118 is defined by a semicircular base or inner edge 119, parallel side edges 120 extending forwardly from the base, and divergent edge portions 121 joining the inner ends of edge portions 117 at the mouth of the opening. The plan form of lower plate 108 is identical to that of plate 107 save that plate 108 has an integral outwardly projecting left lug 122, aligned generally with the position of intermediate partition 110, and an integral outwardly projecting lug 123 at the right front edge portion 117. From the location of intermediate partition 110 forwardly, plates 107 and 108 are relatively thick. From the location of partition 110 rearwardly, the thickness of both plates is markedly reduced by cutting material away from the lower face of plate 107 and from the upper face of plate 108 so that the space between the portions of the plates behind partition 110 is greater than that between the portions of the plates in front of partition 110. Forwardly of partition 110, lower plate 108 has a rectangular upwardly opening recess 124 the long dimension of which is parallel to partition 110, recess 124 being centered on opening 125, as seen in FIG. 12.

Upper plate 112 of unit 106 is identical with the upper plate of unit 105 except for having an integral outwardly projecting left lug 126, aligned with the left front edge of the plate, and an integral outwardly projecting right lug 127 aligned generally with the position of intermediate partition 115. A partial ring 128 is secured to the lower face of bottom plate 108 of upper unit 105 and is concentric with the center of curvature of inner edge 119 of opening 118. Two arcuate ring portions 129 are secured to the upper face of top plate 112 of unit 106 and lie on a circle concentric with the center of curvature of inner edge of the tool joint-accommodating opening of plate 112, the circle defined by ring portions 129 being of slightly larger diameter than that of partial ring 128 so that, in the assembled tongs, partial ring 128 is slidably embraced by ring portions 129.

Figure 13:
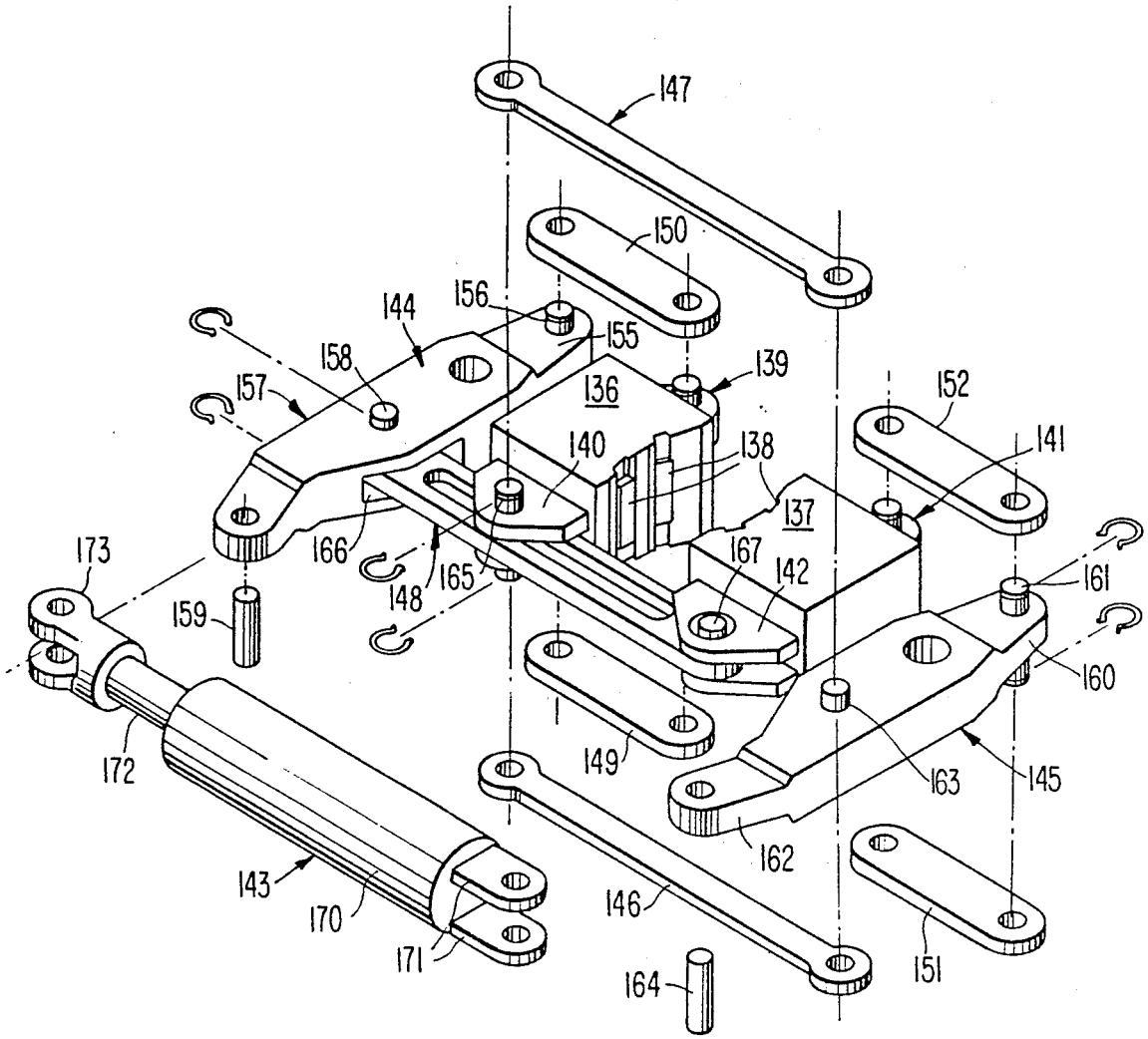
FIG. 13 is an exploded isometric view of the clamp assembly, typical for both the upper and lower tongs of FIG. 12.
Figure 14:
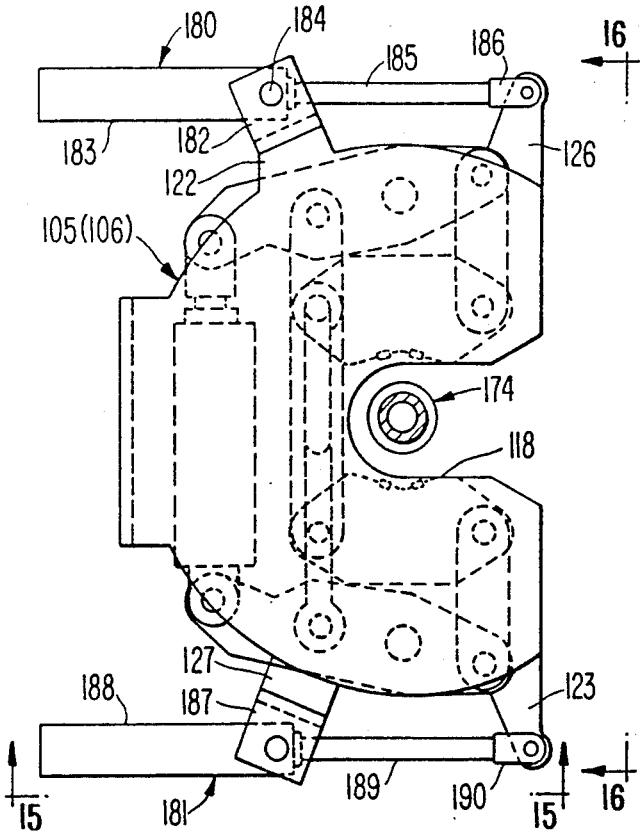
FIG. 14 is a top plan elevational view of the tongs of FIG. 12, showing the apparatus operatively oriented with respect to well pipe but not clamped.

Units 105 and 106 comprise identical clamp assemblies one of which is indicated generally at 135, FIGS. 12 and 13, and will be described in relation to upper unit 105. Each clamp assembly comprises two opposed jaw members 136 and 137 each of generally parallelepiped form save that the opposed clamping faces are arcuate and equipped with gripping elements 138. The jaw members are located between-intermediate partition 110 and front plates 111 and seated slidably in recess 124 of bottom plate 108. As best seen in FIG. 13, there are rigidly secured to jaw member 136 a forwardly projecting lug 139 and a rearwardly projecting clevis bracket 140, the flange and clevis bracket being respectively secured to the front and back sides of the jaw member. Similarly, jaw member 137 is equipped with a forwardly projecting lug 141 and a rearwardly projecting clevis bracket 142. The jaw members are actuated by the combination of hydraulically powered linear actuator 143, two actuating levers 144 and 145, and connecting links 146–152.

Lever 144 is mounted for pivotal movement about a precisely fixed vertical axis determined by a vertical pivot pin 153 extending between and secured to plates 107 and 108. Lever 145 is similarly mounted by pivot pin 154. Lever 144 includes a shorter arm portion 155 which projects forwardly from pin 153 and is equipped with a vertical pivot pin 156, the lever also including a longer arm portion 157 which projects rearwardly from pin 153, has a vertical pivot pin 158 projecting both upwardly and downwardly from a point intermediate the length of portion 157, and terminates in an end portion apertured to receive a vertical pivot pin 159. Similarly, lever 145 includes forwardly projecting shorter arm portion 160, pivot pin 161, rearwardly projecting longer arm portion 162, and pivot pins 163 and 164. Link 146 extends parallel to the front face of intermediate partition 110 and has one end connected to the bottom end of pivot pin 163 of lever 145 and the other end connected to the bottom end of pivot pin 165 of clevis bracket 140. Link 147 is similarly pivotally connected to lever 145 and bracket 140 by the upper ends of pins 163 and 165. Lever 144 has a slot 166 which opens toward clevis bracket 140 and through which pin 158 extends. Link 148 is slotted for a major portion of its length and pin 165 of clevis bracket 140 extends freely through the slot, the respective ends of link 148 being pivotally connected to pin 158 of lever 144 and pin 167 of clevis bracket 142. Links 149 and 150 are connected respectively between the bottom ends and the top ends of pin 155 of lever 144 and pin 168 of lug 139. Similarly, links 151 and 152 are connected respectively between the bottom ends of pin 161 of lever 145 and pin 169 of lug 141. Power device 143 includes cylinder 170, clevis 171 at the blind end of the cylinder, piston rod 172, and clevis 173 at the free end of the rod. Clevis 171 is pivotally connected to the free end of portion 162 of lever 145 by pin 164. Clevis 173 is pivotally connected to the free end of portion 157 of lever 144 by pin 159.

Figure 16:
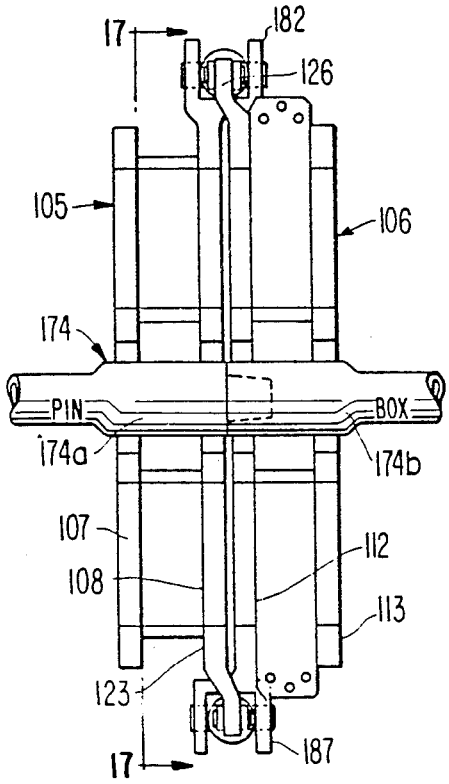
FIG. 16 is a front elevational view taken generally on line 16—16, FIG. 14.
Figure 15:
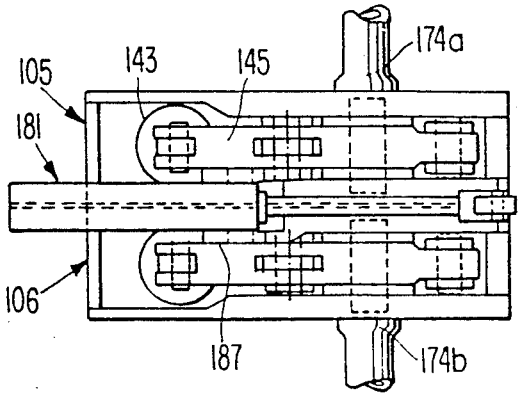
FIG. 15 is a side elevational view taken generally on line 15—15, FIG. 14.
Figure 17:
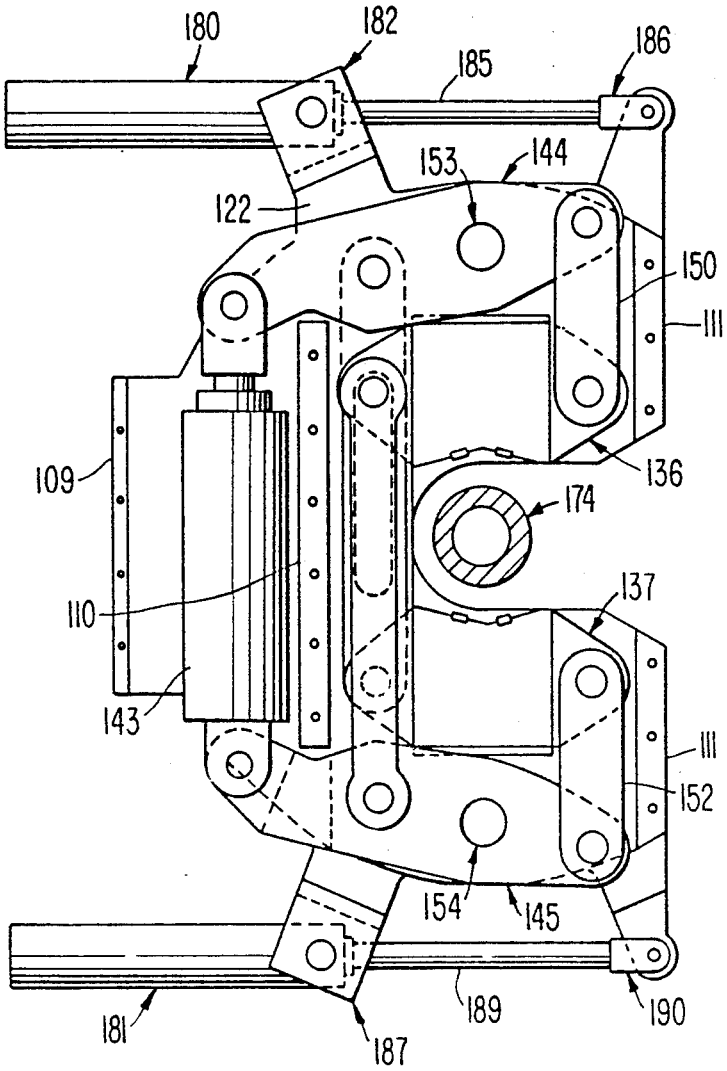
FIG. 17 is a sectional view taken generally on line 17—17, FIG. 16, with the tongs unclamped.
Figure 18:
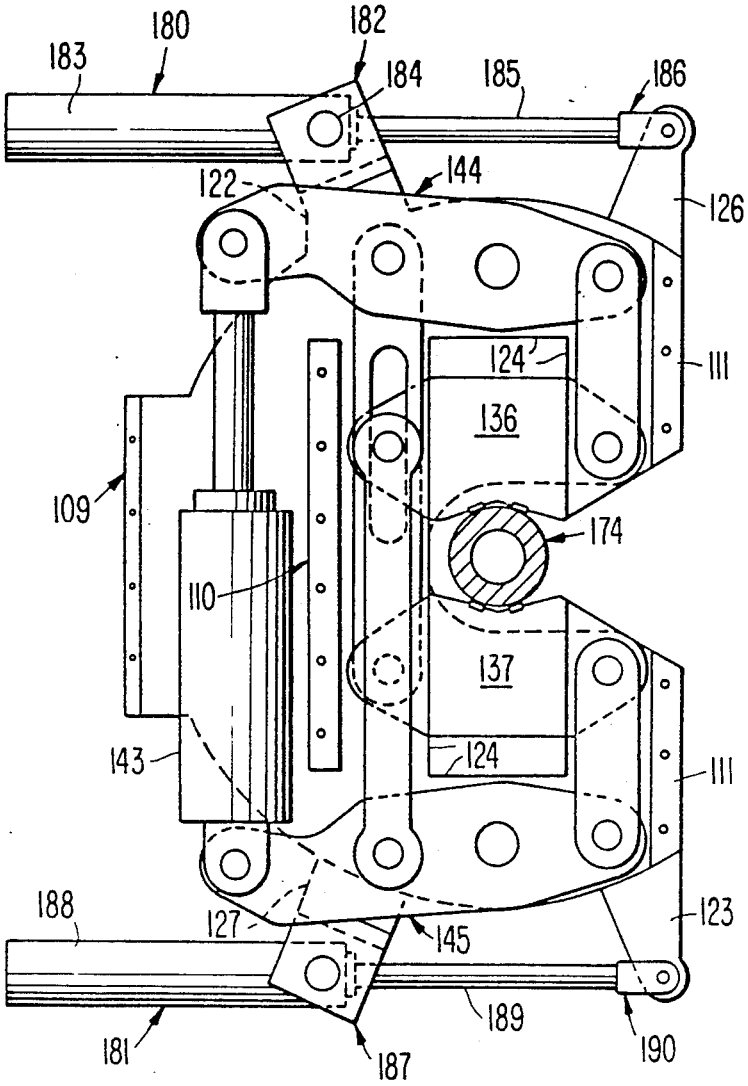
FIG. 18 is a view similar to FIG. 17 but with the tongs clamped on a threaded connector.
Figure 19:
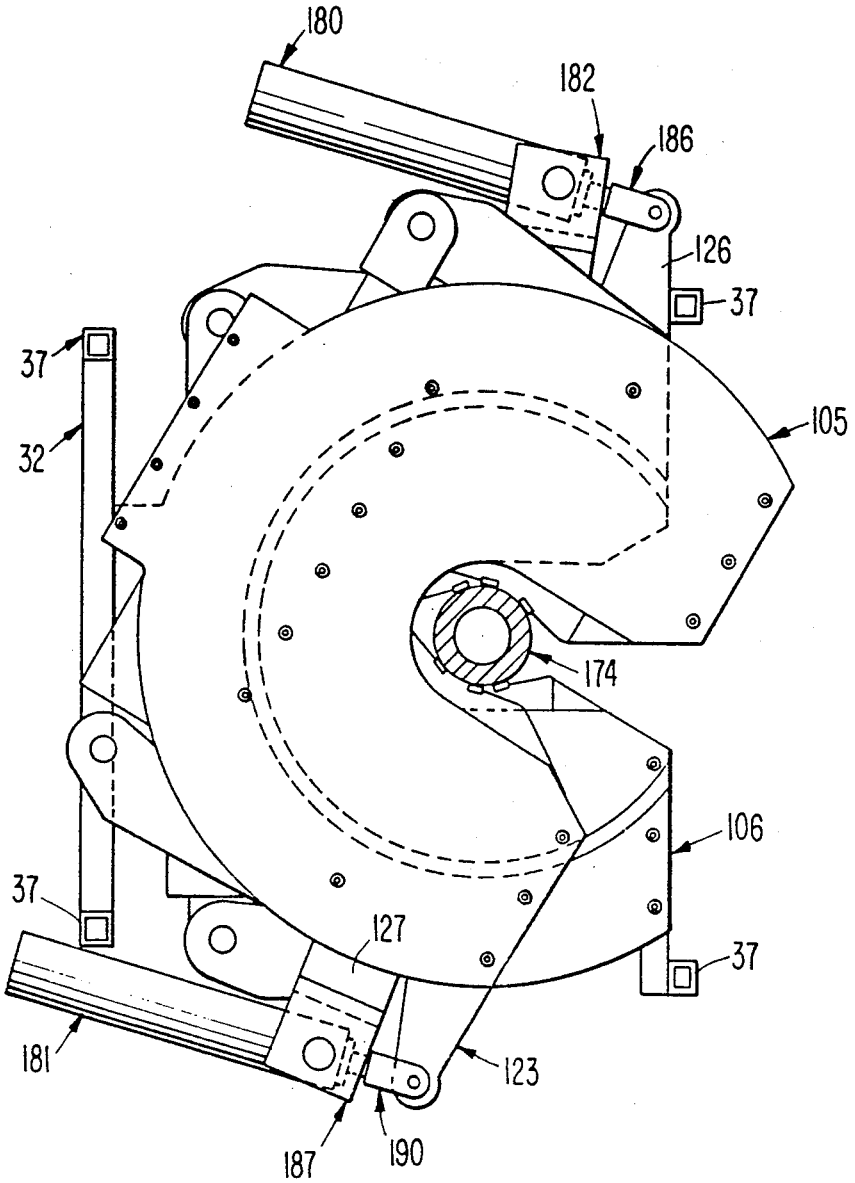
FIG. 19 is a view similar to FIG. 14 showing the tongs clamped and with the upper tongs having been actuated to tighten the threaded pipe connection, FIG. 19 including elements of the movable support frame.

When power device 143 is operated to retract its piston rod, arm portions 157 and 162 of levers 144 and 145 are swung toward each other, pivoting about pins 153 and 154 and causing jaw members 136 and 137 to move away from each other to the fully retracted positions shown in FIG. 17. With the jaw members thus fully retracted, openings 118 and 125 are fully open to receive, e.g., the threaded pipe connection 174. When power device 143 is operate to extend its piston rod, arm portions 157 and 162 of levers 144 and 145 are swung away from each other, causing jaw members 136 and 137 to move toward each other and come into clamping engagement with the pipe connection, as seen in FIG. 18. During movement in either direction, the jaw members are restrained to move rectilinearly because seated in recess 124. As will be clear from FIG. 16, the clamp assembly of upper tongs unit 105 engages upper element **174*a* of the threaded connector 174 while the clamp assembly of lower tongs unit 106 is disposed to engage the lower element 174*b* of connector 174**.

In order to make up and to break connector 174 when gripped by the clamp assemblies, it is necessary to provide relative rotary motion between the upper and lower tongs units about the axis of connector 174. To accomplish this, two hydraulically powered double acting linear actuators 180 and 181 are provided. Secured to lug 122 of bottom plate 108 of unit 105 is a clevis bracket 182 which depends from lug 122 and the legs of which are spaced apart vertically by a distance adequate to freely accommodate the rod end of cylinder 183 of actuator 180 and the cylinder is mounted on bracket 182 by aligned pivot pins 184 secured to and projecting radially from the rod end of the cylinder. The free end of piston rod 185 of actuator 180 is pivotally connected to the end of lug 126 of upper plate 112 of lower tongs unit 106 by clevis 186. As seen in FIG. 16, the free end of lug 126 is displaced upwardly from the plane of plate 112 so that, in the finished assembly, actuator 180 extends parallel to plates 107, 108, 112 and 113 and, therefore, at right angles to the axis of connector 174. Secured to lug 127 of the upper plate of tongs unit 106 is a clevis bracket 187 which projects upwardly from the plane of plate 112. The rod end of cylinder 188 of actuator 181 is pivotally connected to clevis bracket 187, and the free end of piston rod 189 of that actuator is pivotally connected by clevis 190 to the free end of lug 123 of lower plate 108 of the upper tongs unit, the free end of lug 123 being displaced downwardly from the plane of plate 108 to an extent such that actuator 181 is parallel to the top and bottom plates of the tongs units. Actuators 180 and 181 are thus disposed to act along lines which are tangential to a circle drawn about the central axis of connector 174, when the connector is clamped by the tongs units; the cylinder of one actuator is secured to the bottom plate of the upper tongs unit while the free end of the piston rod of that actuator is secured to a point on the top plate of the lower tongs unit; and the cylinder of the other actuator is connected to a point on the top plate of the lower tongs unit while the free end of the rod of that actuator is connected to a point on the bottom plate of the upper tongs units, all of the connections being pivotal. Actuators 180 and 181 are essentially identical and can be operated at the same rate.

To make up connector 174, the frame carrying the power tongs and spinner is positioned at well center, with the connector accommodated by openings 118 and 125, and the clamp assembly of the lower tongs unit is operated to clamp the box **174*b* of the connector. The spinner is then operated to make up the connector to its final stage. The clamp assembly of the upper tongs unit is then operated to clamp pin 174*a*, box 174*b* remaining clamped by the lower tongs unit. Actuators 180 and 181 are now operated to simultaneously retract their piston rods, causing upper tongs unit 105 to rotate clockwise (as viewed from above) relative to tongs unit 106 until tongs unit 105 reaches the position shown in FIG. 19. The torque applied to connector 174 by such rotation of tongs unit 105 is greater than that which can be applied by the spinner and is adequate to accomplish final tightening of the threaded connector. With the connector thus fully made up, both clamping assemblies are operated to release the clamping jaws from the connector, and actuators 180 and 181 are then operated to return upper tongs unit 105 to the position seen in FIG. 17**.

When using the tongs to break threaded connector 174, the frame carrying the tongs and spinner is moved to the well center position, with the jaws of the clamp assemblies open and connector 174 received as shown in FIG. 17. The clamp assembly of the lower tongs unit can then be operated to cause its jaws to clamp box **174*b*. With the jaws of the clamp assembly of the upper tongs unit still retracted, actuators 180 and 181 are then operated to retract their piston rods and turn upper tongs unit 105 to the position seen in FIG. 19. Power device 143 of upper tongs unit 105 is then operated to extend its piston rod, actuating the jaws of the clamp assembly of that tongs unit to clamp pin 174*a*. Actuators 180 and 181 are then operated to extend their piston rods, returning upper tongs unit 105 to the position shown in FIG. 18 and thereby breaking the threaded connection between pin 174*a* and box 174*b*. The clamp assembly of tongs unit 105 is then operated to actuate its jaws to their retracted position, and the power spinner is then employed to perform the major unthreading operation for removal of pin 174*a* from box 174*b*. Actuators 180 and 181 are constructed and arranged to provide potential break-out torque, i.e., when tongs unit 105 is moved from the FIG. 19 position to the FIG. 18** position, in excess of the make-up torque.

It should be noted that, during the clamping operation, the shorter links 150, 152 are placed under a compressive load while the longer links 146, 147 come under a tension load. Due to this reverse loading and to the unequal lengths of the links, the link deflections under load are unequal. Accordingly, the cross-sectional areas of the respective links are predetermined to allow link deflections to maintain transfer of equal forces to the jaw members as clamping is accomplished.

CENTERING DEVICE OF FIGS. 21 AND 22

Figure 21:
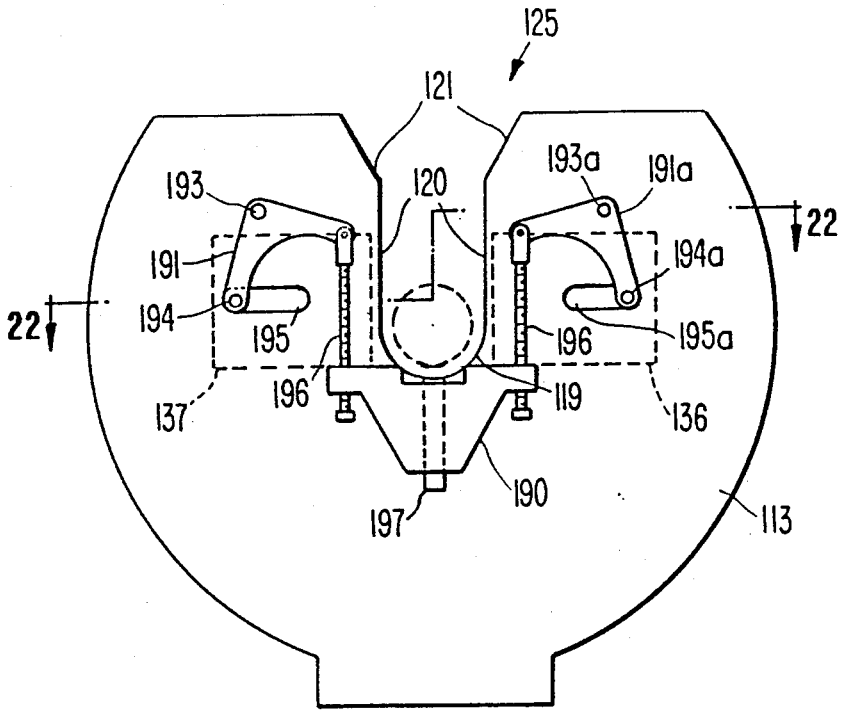
FIG. 21 is bottom plan view of one of the clamp units of the power tongs of FIG. 12 illustrating a centering device according to the invention.
Figure 22:
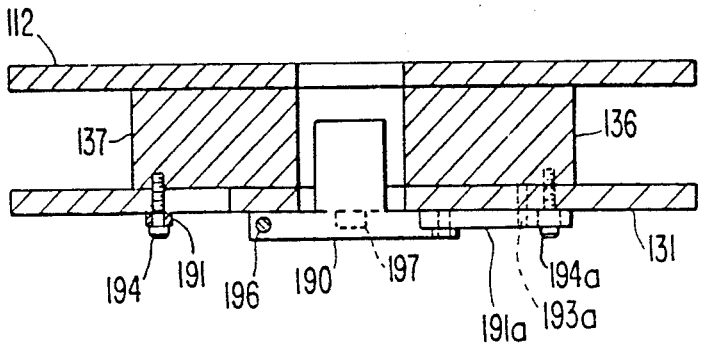
FIG. 22 is a cross-sectional view taken generally on line 22—22, FIG. 21.

Either of tongs units 105, 106 can be equipped with a means for centering the pipe or connector as seen, for example, in FIGS. 21 and 22. Here, a centering member 190 is carried by lower plate 113 of unit 106 in a location centered with respect to arcuate portion 119 of opening 125 and is actuated toward opening 125, simultaneously with movement of the jaw members toward the pipe or connector, by two identical bell crank levers 191 and **191*a* which are pivoted as a result of movement of the jaw members. Bell crank lever 191 is mounted on plate 113 by fixed pivot pin 193 for pivoted movement about its apex, lever 191*a* being similarly mounted by pivot pin 193*a*. One free end of lever 191 is attached to jaw member 137 by a shoulder bolt 194 which passes through an elongated slot 195 in plate 113, the length of the slot extending in the direction of travel of the jaw member. Similarly, one free end of lever 191*a* is attached to jaw member 136 by shoulder bolt 194*a* passing through slot 195*a* in plate 113. The other free end of lever 191 is pivotally connected to the foreward end of a link 196, the link being threaded and adjustably secured in a threaded bore in ear 190*a* of centering member 190. In the same fashion, the other free end of lever 191*a* is connected to the foreward end of link 196 which is threadably secured in ear 190*b* at the side of member 190 opposite ear 190*a*. Centering member 190 is constrained by guide 197 to move only along a straight line which extends at right angles to the direction of movement of the jaw members and also extends through the center of the circular peripheral edge of plate 113 and thus midway between side edges 120 of pipe-accommodating opening 118. Since bell crank levers 191 and 191*a*. are identical, are pivoted on plate 113 at points equidistant from the center line of opening 118, and are attached to like points on jaw members 136 and 137, movement of the jaw members toward each other pivots the levers to move centering member 190 forwardly, and the dimensions and pivot locations are so chosen that the rate of movement of member 190 and the distance travelled by member 190 are equal to the rate and distance of travel of each jaw member. Accordingly, the pipe or connector in opening 118 is subjected to a 3-point centering action, the jaw members providing two points of contact, member 190** providing the third point of contact.

CONTROL SYSTEM FOR APPARATUS SHOWN IN FIGS. 1–8

Figure 20:
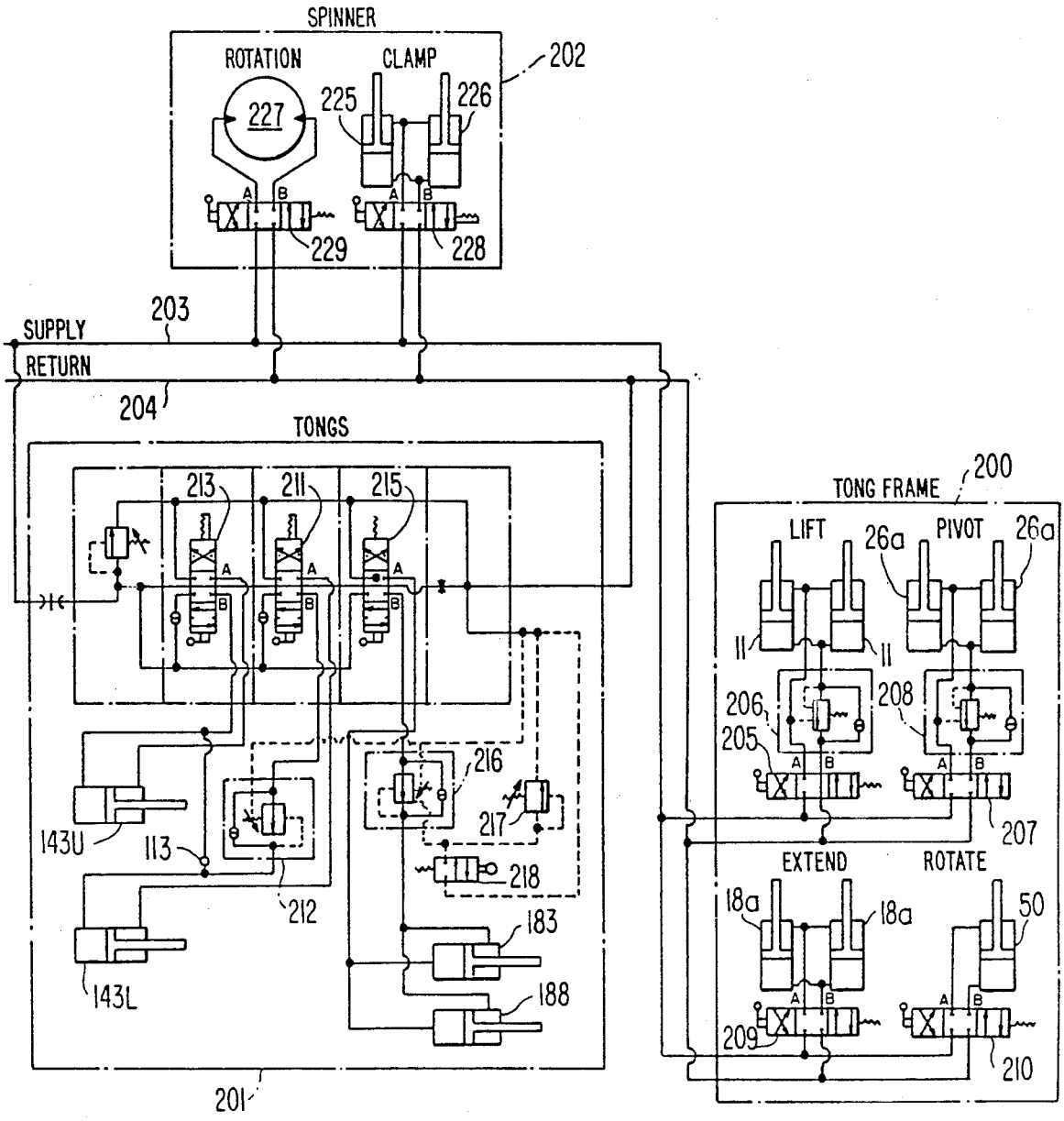
FIG. 20 is a schematic diagram of a hydraulic system for operating the apparatus of FIGS. 1–8 when equipped with the power tongs of FIGS. 12–19.

FIG. 20 illustrates a particularly advantageous hydraulic control system for the apparatus of FIGS. 1–8 when that apparatus is equipped with the power tongs of FIGS. 12–19 and a conventional power spinner, the system comprising portion 200 for operating the power devices for positioning support frame 32, a portion 201 for operating the power tongs and a portion 202 for operating the power spinner, all power components of the system operating from a common pressure fluid supply line 203 and return line 204.

Figure 5:
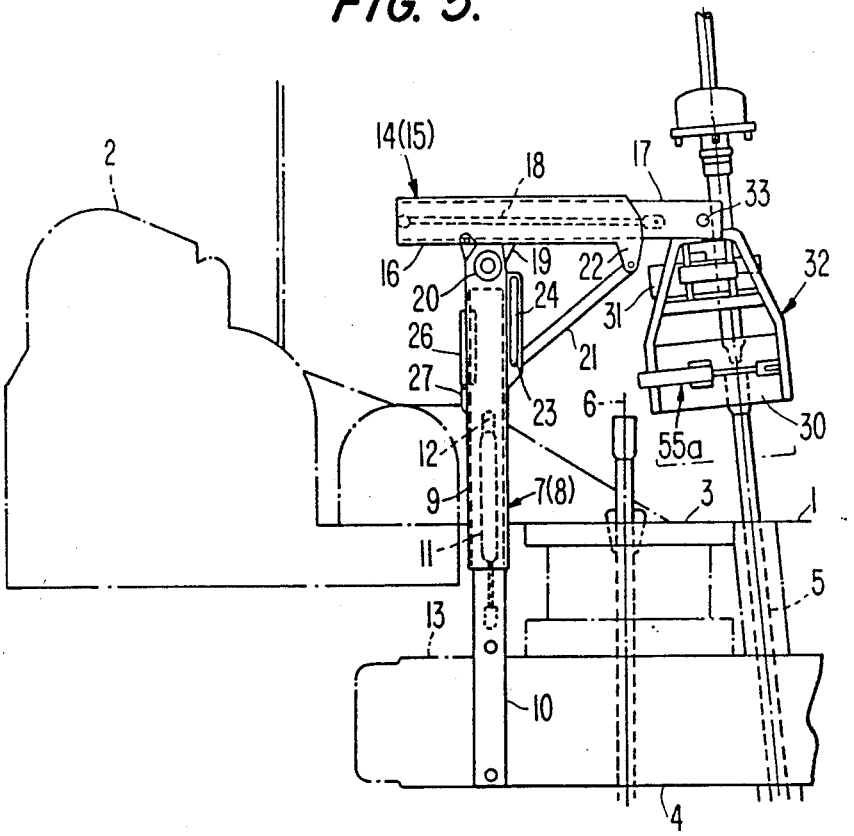
FIG. 5 is a view similar to FIG. 1 but showing the movable support frame in the mousehole position.
Figure 6:
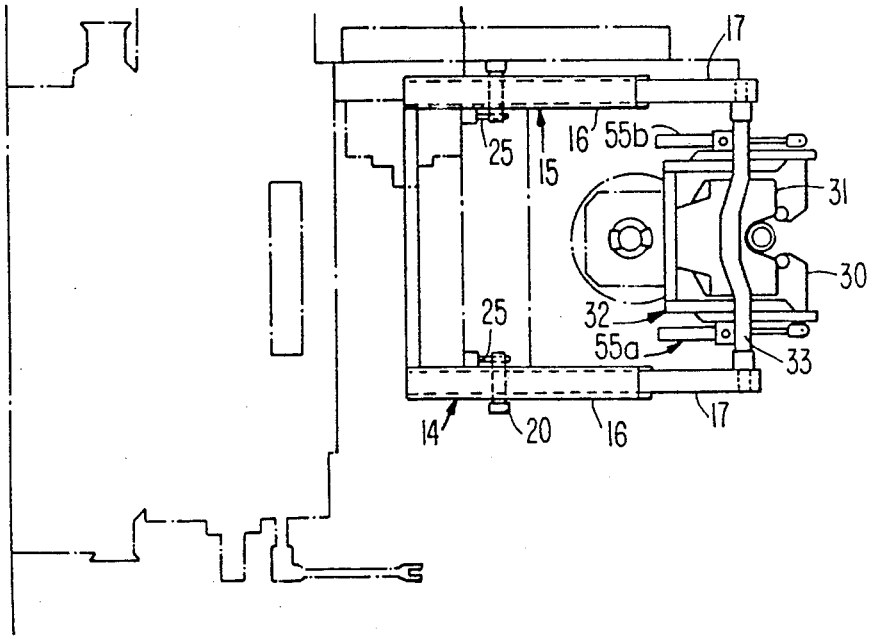
FIG. 6 is a top plan view of the apparatus with the parts in the positions seen in FIG. 5.

In portion 200 of the system, cylinders 11 of the two lift actuators are parallel connected to lines 203 and 204 via a conventional direction control valve, shown diagrammatically at 205, and a conventional counterbalance valve illustrated diagrammatically at 206. Shifting valve 205 to position A causes the lift actuators to retract their piston rods 13 simultaneously and shorten legs 7 and 8, thereby lowering the combination of support and positioning arms 14, 15 and frame 32. Shifting of valve 205 to position B causes the lift actuators to extend their piston rods simultaneously and thereby extend legs 7 and 8, raising the combination of arms 14, 15 and frame 32. Counterbalance valve 206 is included to prevent oscillation when, with valve 205 in position B, the lift actuators operate to lift the load applied via legs 7 and 8. Cylinders 26*a* of the linear actuators 26 which swing arms 14 and 15 relative to legs 7 to move frame 32 to and from the stowed position are also connected in parallel to lines 203 and 204 via conventional direction control valve 207 and a conventional counterbalance valve 208. When valve 207 is in position A, actuators 26 simultaneously retract their piston rods to swing arms 14, 15 and frame 32 to the stowed position shown in FIG. 1. Shifting valve 207 to position B causes actuators 26 to extend their piston rods to swing arms 14 and 15 to their horizontal position, seen in FIG. 3. Counterbalance valve 208, again positioned between the direction control valve and the cylinders, prevents oscilation of arms 14 and 15 during operation of the linear actuators. Cylinders 18*a* of linear actuators 18 are connected in parallel to lines 203 and 204 via conventional directional control valve 209. When valve 209 is in position B, cylinders 18*a* operate to extend the piston rods of actuators 18 simultaneously, thereby extending arms 14 and 15 simultaneously. In position A, valve 209 causes retraction of the piston rods of actuators 18, thereby retracting arms 14 and 15. The cylinder 50 of frame pivot motor 49 is connected to lines 203 and 204 via direction control valve 210. When valve 210 is in position B, motor 49 extends its piston rod, causing frame 32 to pivot counterclockwise relative to arm 14 and 15 to bring the frame into alignment with the mousehole as shown in FIG. 5. Shifting valve 210 to position A causes motor 49 to retract its piston rod, causing frame 32 to return to its vertical position. Valve 210 is also maintained in position B when motor 49 is used to maintain frame 32 vertical as arms 14 and 15 are swung to and from the stowed position.

In portion 201 of the system, cylinder 143L of linear actuator 143 of lower tongs unit 106 is connected to lines 203 and 204 via a conventional direction control valve 211 and a conventional pressure limiting valve 212. When valve 211 is in position A, the actuator retracts its piston rod, retracting the jaws of the lower tongs unit. In position B, the valve causes the actuator to extend its piston rod to move the jaws to clamping position. Pressure limiting valve 212 serves to limit the clamping force applied by the jaws of lower tong unit 106 until clamping operation of upper tongs unit 105 has commenced. Cylinder 143U of the linear actuator 143 of upper tongs unit 105 is connected to lines 203 and 204 via direction control valve 213. A check valve 214 is connected between the conduits connected to the blind ends of cylinders 143L and 143U and is oriented to block flow from the conduit leading to cylinder 143L. In position A, valve 213 causes the piston rod of cylinder 143U to retract, retracting the jaws of the upper tongs unit. In position B, valve 213 causes the piston rod of cylinder 143U to extend so that the jaws of the upper tongs unit are driven to clamping positions. Once the pressure in the conduit leading to the blind end of cylinder 143U reaches a value exceeding that in the conduit leading to the blind end of cylinder 143L, check valve 214 unseats and equal pressures will be applied to the pistons of both actuators 143 so that the jaws of both tongs units clamp with the same force. Cylinders 183 and 188 of actuators 180 and 181, respectively, are connected in parallel to direction control valve 215 and thus to lines 203 and 204. An adjustable pressure limiting valve 216 is connected between the rod ends of the cylinders and valve 215. An additional pressure limiting valve 217 is connected to valve 216 to act as a bias valve. A two position valve 218 is connected in parallel with valve 217 so as to be capable of, in effect, venting the line in which valve 217 is connected. When valve 215 is in position B, actuators 180 and 181 are operated to retract their piston rods, causing upper tongs unit 105 to turn from the position of FIG. 18 to that shown in FIG. 19, for making up connector 174. With valve 215 in the B position, valve 216 limits the torque applied to connector 174 as the upper tongs unit is turned to the FIG. 19 position, the value to which the torque is limited being determined by the setting of valve 116 and the setting of biasing valve 217. Valve 218 bypasses valve 217 in response to arrival of the piston rods of actuators 180 and 181 at the end of their stroke and thus prevents false torque readings as the actuators "bottom out". When valve 215 is in position B actuators 180 and 181 are operated to extend their piston rods and thus return the upper tongs unit from the position shown in FIG. 19 to that seen in FIG. 18, as is required for breaking threaded connector 174.

Conventional power spinners suitable for use in accordance with the invention can comprise linear actuators for actuating the pipe clamp, the actuators having cylinders 225 and 226. A rotary power device 227 is used to spin the pipe. In portion 202 of the control system, cylinders 225 and 226 are connected in parallel to lines 203 and 204 via conventional direction control valve 228. Rotary power device 227 is connected to lines 203 and 204 via direction controlling valve 229. It will be apparent that valve 228 can be adjusted to cause the pipe clamp to clamp or release, and that the direction of rotation of device 227 can be selected by operation of valve 229.

OPERATION OF THE APPARATUS OF FIGS. 1–8 USING CONTROL SYSTEM SHOWN IN FIG. 20

Assuming that the apparatus employs the power tongs described with reference to FIGS. 12–19 and that support arms 14, 15 and frame 32 are in the stowed position shown in FIG. 1, the operational sequence to make up threaded pipe connector 174 is as follows:

Step 1. Shift valve 207 to position B, to cause actuators 26 to extend their piston rods and swing arms 14 and 15 from vertical to horizontal. Simultaneously, shift valve 210 to position B, causing actuator 49 to extend its piston rod at a rate maintaining frame 32 in its vertical position as arms 14 and 15 swing.

Step 2. Shift valve 205 to position B, causing the piston rods of cylinders 11 to extend, increasing the length of legs 7 and 8 to raise frame 32 to the proper height for the power tongs to function.

Step 3. Shift valve 228 to position B, causing cylinders 225, 226 to extend their piston rods so that the clamping device of the spinner clamps onto the upper joint of pipe.

Step 4. Shift valve 211 to position B, causing actuator 143 of lower tongs unit 106 to extend its piston rod and actuate the clamping device of unit 106 to clamp box 174*b* of the connector, valve 212 serving to limit the maximum clamping pressure to the level preset by the operator.

Step 5. Shift valve 229 to position B to cause power device 227 to rotate the upper joint of pipe until pin 174*a* is spun into the box.

Step 6. Shift valve 228 to position A to release the clamping device of the spinner from the pipe.

Step 7. Shift valve 213 to position B to operate actuator 143 of upper tongs unit 105 to actuate the jaws of unit 105 into clamping engagement with pin 174 of the connector. Once the hydraulic pressure in cylinder 143U equals that in cylinder 143L, bothtongs units will operate to clamp with the same force.

Step 8. Shift valve 215 to position B, causing actuators 180 and 181 to retract their piston rods and thereby rotate upper tongs unit 105 from the position seen in FIG. 19 to that of FIG. 18. Once the torque on the threaded connector reaches the valve preset by adjusting valve 216, the connector has been properly torqued and cylinders 183 and 188 are deenergized.

Step 9. Shift valves 213 and 211 to position A, causing actuators 143 of both tongs units to actuate the jaws of the tongs units to released positions.

Step 10. Shift valve 215 to position A, causing actuators 180 and 181 to extend their piston rods and rotate upper tongs unit 105 back to the position shown in FIG. 18.

Step 11. For mousehole operation, shift valve 205 to position B, causing the piston rods of cylinders 11 to further extend, raising frame 32 enough for pass over clearance with respect to the joint of pipe remaining in the slips at the rig floor, then shift valve 209 to position B to cause actuators 18 to extend arms 14 and 15 to bring frame 32 to the mousehole position.

Step 12. Shift valve 210 to position B, causing motor 49 to extend its piston rod and rotate frame 32 into alignment with the mousehole receptacle.

Step 13. Repeat Steps 2-9.

Step 14. Shift valve 209 to position A to cause return of frame 32 to the well center position.

It will be apparent that the procedure for breaking a threaded connector is essentially the reverse of that described above for making up the connector. Adaption of the control system and operating procedure to the apparatus shown in FIGS. 9–11 will also be apparent.

What is claimed is:

1. In an apparatus for making and breaking threaded well pipe connections, the apparatus being adapted to be mounted at the floor of a drilling rig having a well center and a mousehole receptacle, the combination of stationary support means adapted to be mounted on the rig to extend upwardly from the rig floor in a position spaced from the well center;

power operated tongs;

movable support means, the power operated tongs being carried by the movable support means; and supporting and positioning means operative to selectively position the tongs in a stowed position, a well center position in which the tongs are operatively disposed to act on pipe at the well center, and a mousehole position in which the tongs are operatively disposed to act on pipe in the mousehole, the supporting and positioning means comprising mounting means for mounting the supporting and positioning means on the stationary support means, and first power operated means for moving the movable support means between the stowed position, the well center position and the mousehole position, said first power operated means including second power operated means for moving the movable support means upwardly and downwardly to adjust the space between the tongs and the rig floor.

2. The combination defined by claim 1, wherein the mounting means for mounting the supporting and positioning means on the stationary support means comprises at least one telescopically extendable and retractable arm, the movable support means is mounted on one end portion of the at least one arm, and the other end portion of said at least one arm is mounted on the stationary support means.

3. The combination defined by claim 2, wherein the movable support means comprises a frame structure which supports the tongs, the frame structure being mounted on the at least one arm for pivotal movement about a horizontal axis.

4. The combination defined by claim 3, wherein said first power operated means further comprises third power operated means constructed and arranged to swing the frame structure from an upright position, in which the tongs are disposed to act on a vertical pipe, to an inclined position, in which the tongs are disposed to act on a pipe in the mousehole receptacle.

5. The combination defined by claim 2, wherein said other end portion of said at least one arm is pivotally mounted on the stationary support means; and the first power operated means includes means for swinging the at least one arm from a generally horizontal position, occupied by the at least one arm when the movable support means is at the well center position, to a generally upright position, occupied by the at least one arm when the movable support means is in the stowed position.

6. The combination defined by claim 5, wherein the stationary support means comprises two upright members which are spaced apart horizontally;

the supporting and positioning means comprises two telescopically extendable and retractable arms which are mutually parallel, said other end portion of each of said arms being pivotally mounted on a different one of said two upright members; and the movable support means includes an upper portion disposed between and pivotally mounted on said one end portions of the arms, the movable support means depending from the arms in a position between the upper end portions of the two upright members when the movable support means is in its stowed position.

7. The combination defined by claim 2, wherein the at least one arm is hollow, and the combination further comprises an expansible chamber rectilinear pressure fluid operated power device housed within said at least one arm for extending and retracting the same.

8. The combination defined by claim 1, wherein the stationary support means comprises at least one upright member which is telescopically extendable and contractable; and the second power operated means is constructed and arranged to selectively extend and retract said at least one upright member.

9. The combination defined by claim 2, wherein the stationary support means comprises at least one upright member, and a slide member movable upwardly and downwardly on the at least one upright member;

said other end portion of the at least one arm is mounted on the slide member;

the supporting and positioning means comprises a cable having one end secured at said one end of the at least one arm, the cable extending upwardly, over a sheave mounted on the rig above the supporting and positioning means, thence downwardly to the location of the stationary support means, the other end of the cable being connected to the supporting and positioning means; and the second power opeated means includes means for manipulating the cable to raise and lower the at least one arm, the movable support means and the tongs.

10. The combination defined by claim 9, wherein said means of the second power operated means for manipulating the cable includes a pressure fluid operated rectilinear power device having a cylinder and piston; and said other end of the cable is connected to one of the cylinder and the piston rod, the other of the cylinder and the piston rod being attached to a fixed point on the stationary support means.

11. The combination defined in claim 10, wherein the rectilinear power device of the second power operated means is connected to the slide member to move the slide member upwardly and downwardly in unison with movement of said other end of the cable.

12. The combination defined in claim 11, wherein the supporting and positioning means further comprises a second sheave mounted below said at least one arm;

the cable extends downwardly, about the second sheave, and thence upwardly to said other end; and the pressure fluid operated rectilinear power device of the second power operated means is connected between said other end of the cable and said fixed point.

13. The combination defined by claim 12, wherein the stationary support means comprises two upright members which are spaced apart horizontally; and the second sheave and the pressure fluid operated power device of the second power means are located between the two upright members.

14. The combination defined by claim 13, wherein the slide member embraces the two upright members of the stationary support means;

the stationary support means comprises a cross member interconnecting the upper ends of the two upright members, the slide member being located below said cross member and the space within the slide member between the two upright members is open;

said fixed point is on said cross member;

the cylinder of the pressure fluid operated rectilinear power device of the second power operated means is connected to said fixed point and extends downwardly within the slide member; and both the piston rod of the pressure fluid operated rectilinear power device and said other end of the cable are connected to a lower portion of the slide member.

15. The combination defined by claim 9, wherein the stationary support means comprises two upright members which ar spaced apart horizontally;

the mounting means for mounting the supporting and positioning means on the stationary support means comprises two telescopically extendable and retractable arms each secured at one end to the slide member;

the movable support means comprises a frame which carries the power operated tongs and includes an upper portion, like end portions of said two arms each extending adjacent a different side of the frame;

the combination further comprising two frame brackets each secured to a different one of two spaced points on the upper portion of the frame, said brackets being apertured and carrying bushings which are aligned to define a horizontal pivotal axis, two rod brackets each secured to a different one of the extendable and retractable arms and having apertures aligned with the bushings of the frame brackets, shaft means extending through the bushings of the frame brackets and the apertures of the rod brackets, whereby the frame is pivotally suspended from the extendable and retractable arms, and a spreader member having two upright flanges spaced apart along the length of said axis and pivotally connecting the spreader member to the frame and arms, said one end of the cable being connected to the spreader member at a point centered between the flanges of the spreader member.

16. The combination defined by claim 4, wherein the power operated tongs comprise an upper tongs unit having clamping jaws and a pressure fluid operated rectilinear actuator for moving the jaws to clamping positions and to released positions, a lower tongs unit having clamping jaws and a pressure fluid operated rectilinear actuator for moving the jaws to clamping positions and to released positions, and pressure fluid operated torquing power means for rotating one of the tongs units relative to the other to make or break a threaded connector clamped by the jaws of the two units;

the combination further comprising a pressure fluid control system for remote operation of the apparatus, the control system comprising a first direction control valve connected to operate the first power operated means selectively for moving the movable support means upwardly and downwardly, a second direction control valve connected to operate the second power operated means selectively to the stowed position, the well center position and the mousehole position, a third direction control valve connected to operate the third power means to swing the frame structure in both directions, fourth and fifth direction control valves each connected to operate a different one of the rectilinear actuators of the tongs units to operate the jaws of the two tongs units independently of each other, and a sixth direction control valve connected to operate the torquing power means for rotating one of the tongs units relative to the other.

* * * * *